United States Patent [19]

Asselman et al.

[11] 4,095,647

[45] Jun. 20, 1978

[54] HEATING DEVICE

[75] Inventors: George Albert Apolonia Asselman; Josef Wilhelmus Johannes Maria Van der Leegte, both of Eindoven, Netherlands

[73] Assignee: U.S. Philips Corporation, Briarcliff Manor, N.Y.

[21] Appl. No.: 631,506

[22] Filed: Nov. 13, 1975

Related U.S. Application Data

[62] Division of Ser. No. 378,245, Jul. 11, 1973, Pat. No. 3,955,618.

[30] Foreign Application Priority Data

Jul. 9, 1972 Netherlands ..... 7209936

[51] Int. Cl.[2] ..... F28D 15/00

[52] U.S. Cl. ..... 165/105; 219/326; 219/399; 219/540; 432/91

[58] Field of Search ..... 165/105; 137/13, 334; 432/91; 219/326, 378, 399, 530, 540

[56] References Cited

U.S. PATENT DOCUMENTS

| | | | |
|---|---|---|---|
| 1,987,119 | 1/1935 | Long | 165/105 X |
| 2,885,309 | 5/1959 | Brunke | 165/105 X |
| 3,651,240 | 3/1972 | Kirkpatrick | 165/105 X |
| 3,728,518 | 4/1973 | Kodaira | 165/105 |
| 3,770,051 | 11/1973 | Kodaira | 165/105 |
| 3,955,618 | 5/1976 | Asselman et al. | 165/105 |

FOREIGN PATENT DOCUMENTS

| | | | |
|---|---|---|---|
| 2,430,880 | 2/1975 | Germany | 165/105 |

*Primary Examiner*—Charles J. Myhre
*Assistant Examiner*—Sheldon Richter
*Attorney, Agent, or Firm*—Frank R. Trifari; Rolf E. Schneider

[57] ABSTRACT

A heating device comprising a plurality of heating chambers, each chamber being bounded by the heat-transmission wall of a reservoir in which a heat transport medium is present which completes an evaporation/condensation cycle. The reservoirs are connected, via a common reservoir which also contains heat transport medium, to the same common heat source.

3 Claims, 10 Drawing Figures

HEATING DEVICE

This is a division, of application Ser. No. 378,245, filed July 11, 1973 now U.S. Pat. No. 3,955,618.

BACKGROUND OF THE INVENTION

This invention relates to a heating device, provided with a heating chamber for objects, bounded by at least one heat-transmission wall whose side which is remote from the heating chamber forms part of the boundary of a reservoir in which a heat transport medium is present which completes an evaporation/condensation cycle during operation, involving on the one hand evaporation by taking up heat originating from a heat source and, on the other hand, condensation on the heat-transmission wall while giving off heat thereto.

A heating device of the kind set forth is described in application Ser. No. 534,621 filed Dec. 19, 1974, now U.S. Pat. No. 3,943,964, which is a continuation of application Ser. No. 159,205 filed July 2, 1971, now abandoned. Liquid heat transport medium which evaporates from the wall to which heat is supplied moves in the vapour phase to the heat-transmission wall as a result of any locally prevailing lower vapour pressure due to a slightly lower local temperature. Subsequently, the vapour condenses on the heat-transmission wall while giving off heat thereto, the said heat being given off through the wall to the heating chamber for the benefit of one or more objects to be subjected to heat treatment. The condensate is returned by capillary forces, via a capillary structure, to the wall where heat is supplied and where it is evaporated again. It is alternatively possible that the condensate is returned exclusively by gravity, i.e. without a capillary structure being present.

The major advantage of this kind of heating device is that a fully isothermal heating chamber is obtained in a comparatively simple manner, which is of major practical importance particularly in ovens. The isothermal nature results from the fact that the most vapour always condenses at the area on the heat-transmission wall where the lowest vapour pressure prevails. A locally lower temperature, consequently, is immediately compensated for.

It often occurs in practice that a plurality of heating devices which are constructed as an oven, each device comprising only one heating chamber, are simultaneously used at the same operating temperature in a factory hall. An example in this respect is the simultaneous use of a plurality of tunnel ovens where one or more wires which are covered with a layer of lacquer are fed through each oven in a continuous process in order to bake the lacquer on the wire. Each oven then has its own heat source such as a burner, an electric heating wire, a high-frequency induction coil or similar.

SUMMARY OF THE INVENTION

The invention has for its object to provide a structurally simple multi-chamber heating device which can completely take over the combined task of the separately arranged heating devices and which is cheaper than the independent heating devices together. So as to realize this object, the heating device according to the invention is characterized in that when use is made of a plurality of heating chambers, the relevant reservoirs are connected, via a common reservoir which also contains heat transport medium, to the same common heat source at the area of a common reservoir evaporation wall. An attractive multi-heating chamber device is thus obtained, comprising one central heat source for all chambers instead of an individual heat source for each chamber.

In a preferred embodiment of the heating device according to the invention, the reservoirs are at least partly situated inside the common reservoir and are separated from the commmon reservoir by heat-transmission reservoir walls. An evaporation/condensation process takes place in the common reservoir as well as in the reservoirs. In the common reservoir heat transport medium transports heat from the common heat source to the heat-transmission reservoir walls; in the reservoirs the heat which is taken up by the heat transport medium from the heat-transmission reservoir walls is transported to the heat-transmission wall. The manufacture of such a heating device is simple; the reservoirs can be inserted in openings in the wall of the common reservoir, after which they are sealed with respect to the common reservoir.

A further preferred embodiment of the heating device according to the invention is characterized in that the reservoirs and the common reservoir are in open communication with each other. This offers a further structural simplification. There is now only one evaporation/condensation cycle, while temperature gradients and heat losses which occur in the case of partitions which have a thermal resistance are prevented.

In a further preferred embodiment of the heating device according to the invention, the common reservoir accommodates a capillary structure which connects the common reservoir evaporation wall to the reservoirs for the return of heat transport medium condensate from the reservoirs to the common reservoir evaporation wall. This renders the position of the heating device independent with respect to the common reservoir.

Another preferred embodiment of the device according to the invention is characterized in that the common heat source is arranged inside the common reservoir at the area of the common reservoir evaporation wall. It is thus achieved that the common heat source cannot be damaged, while the construction of the heating device is also more compact.

Some embodiments of the heating device according to the invention will be described hereinafter, by way of example, with reference to the diagrammatic drawing which is not to scale.

DESCRIPTION OF THE PREFERRED EMBODIMENTS

FIGS. 1*a* to 1*c*, 2*a* to 2*c*, and 3*a* to 3*b* show heating devices, each comprising four heating chambers, which are constructed as continuous tunnel ovens. In the oven shown in FIGS. 1*a* to 1*c*, the heating chambers are bounded by double-walled cylindrical reservoirs which are passed through a common reservoir which is provided with a common heat source.

Figure 1A:
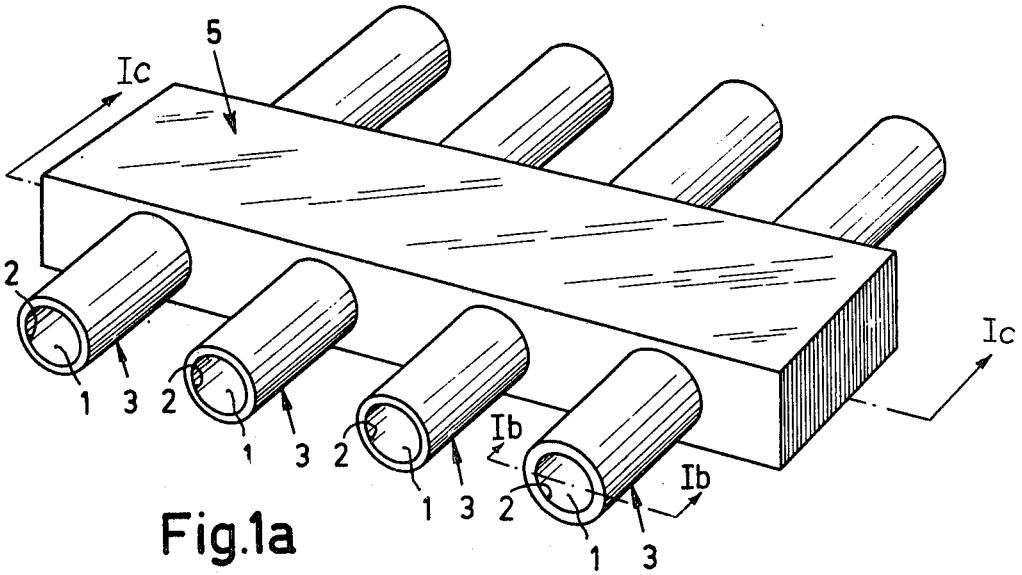
FIG. 1*a* is a perspective view of a heating device of the new invention comprising four heating chambers.

The continuous oven of FIG. 1*a* comprises the four heating chambers which are denoted by the reference numeral 1. Each heating chamber 1 is bounded by a heat-transmission wall 2 of a reservoir 3 containing sodium as the heat transport medium. As appears from FIG. 1*b*, the inner walls of reservoir 3 are covered with a capillary structure 4. FIG. 1*a* furthermore shows a common reservoir 5 which also contains sodium as the heat transport medium. The reservoirs 3 are passed through common reservoir 5. The reservoir walls which separate the reservoirs from the common reservoir are heat-transmitting.

Figure 1B:
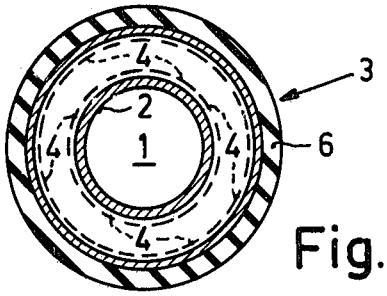
FIG. 1*b* is a view of a reservoir taken along line I*b*—I*b* of FIG. 1*a*.
Figure 1C:
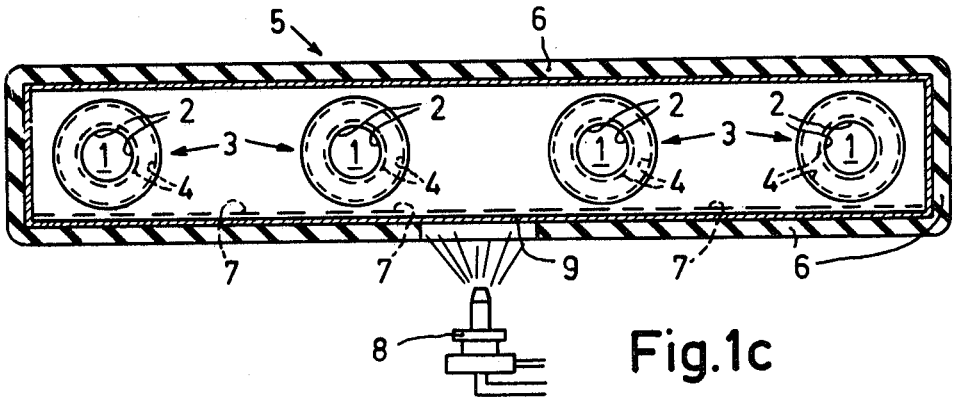
FIG. 1*c* is a cross-sectional view of the oven taken along line I*c*—I*c* of FIG. 1*a*.

In FIG. 1*c* the outer walls of the oven are covered with a heat-insulating layer 6. The bottom of common reservoir 5 is covered with a capillary structure 7. Heat is supplied to the oven by means of a burner 8, via a common reservoir evaporation wall 9.

The operation of the oven is as follows. Due to the supply of heat to common reservoir 5, liquid sodium which is present in capillary structure 7 evaporates. Sodium vapor subsequently condenses on the parts of the outer walls of reservoirs 3 which are situated inside the common reservoir, while giving off heat thereto. Due to gravity, the sodium condensate is returned to the capillary structure 7 again. The sodium condensate is fed by capillary forces through this capillary structure to common reservoir evaporation wall 9 where burner 8 supplies heat to the common reservoir. The returned condensate is then evaporated again.

The sodium in the reservoirs 3 is in reservoir 5 completes an evaporation/condensation cycle. Due to the taking up of heat from the common reservoir 5, sodium evaporates in reservoirs 3 and condenses on heat-transmission walls 2 while giving off heat thereto. The given off heat is given off to heating chambers 1 via the heat-transmission walls 2. Sodium condensate is returned from heat-transmission walls 2 to the heat-transmission outer wall parts of the reservoirs via the capillary structure 4. A simple isothermal multi-chamber oven is thus obtained, in which all chambers are centrally controlled by a single heat source.

Figure 2A:
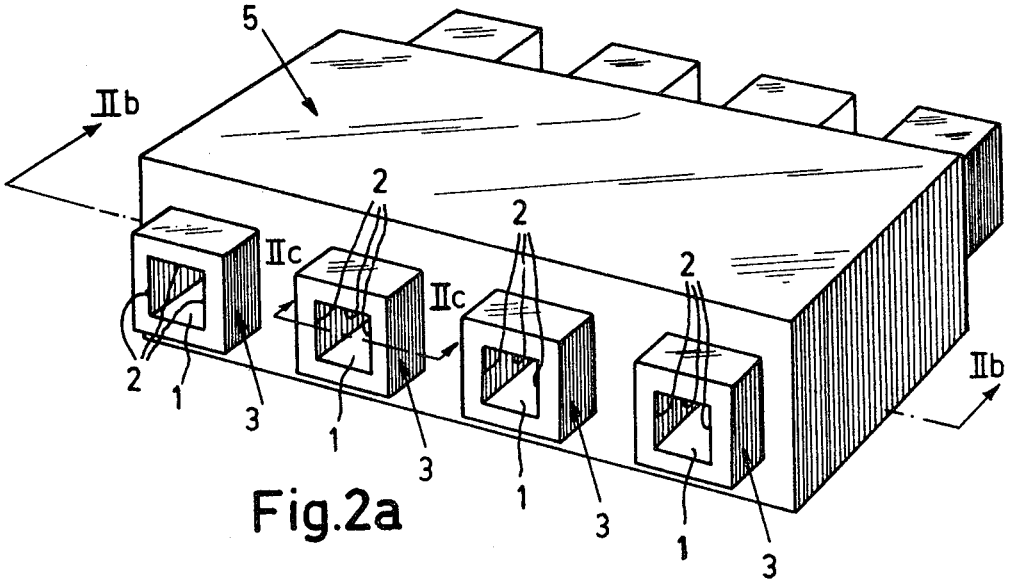
FIG. 2*a* is a perspective view of a second embodiment of the heating device of this invention, comprising four heating chambers each having rectangular cross-section.
Figure 2B:
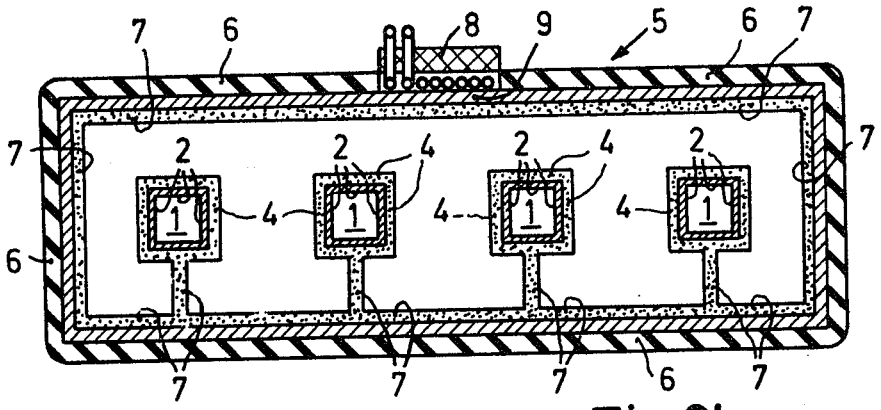
FIG. 2*b* is a sectional view taken along line II*b*—II*b* of FIG. 2*a*.
Figure 2C:
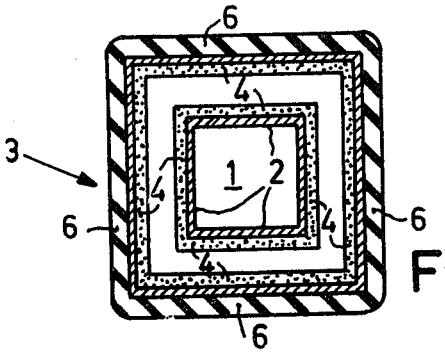
FIG. 2*c* is a sectional view of a reservoir taken along line II*c*—II*c* of FIG. 2*a*.

The oven shown in FIGS. 2*a* to 2*c* comprises heating chambers having a rectangular section. The reservoirs are now in open communication with the common reservoir which comprises the common heat source. In the tunnel oven shown in FIGS. 2*a* to 2*c* the parts corresponding to parts of the oven shown in FIGS. 1*a* to 1*c* are provided with the same references. Reservoirs 3 are in open communication with common reservoir 5, as appears from FIG. 2*b*. The capillary structure 7 inside the common reservoir 5 now covers the entire inner wall of this reservoir and communicates on the lower side with the capillary structure 4 on the heat-transmission walls 2 of the reservoirs 3. An electric heating element, mounted on the common reservoir 5, is now provided as the heat source 8. Liquid sodium again evaporates from the common reservoir evaporation wall 9 and now condenses directly on the heat-transmission walls 2 of the reservoirs 3 while giving off heat thereto. Via capillary structures 4 and 7, sodium condensate is returned to common reservoir evaporation wall 9 where it is evaporated again by common heat source 8.

Figure 3A:
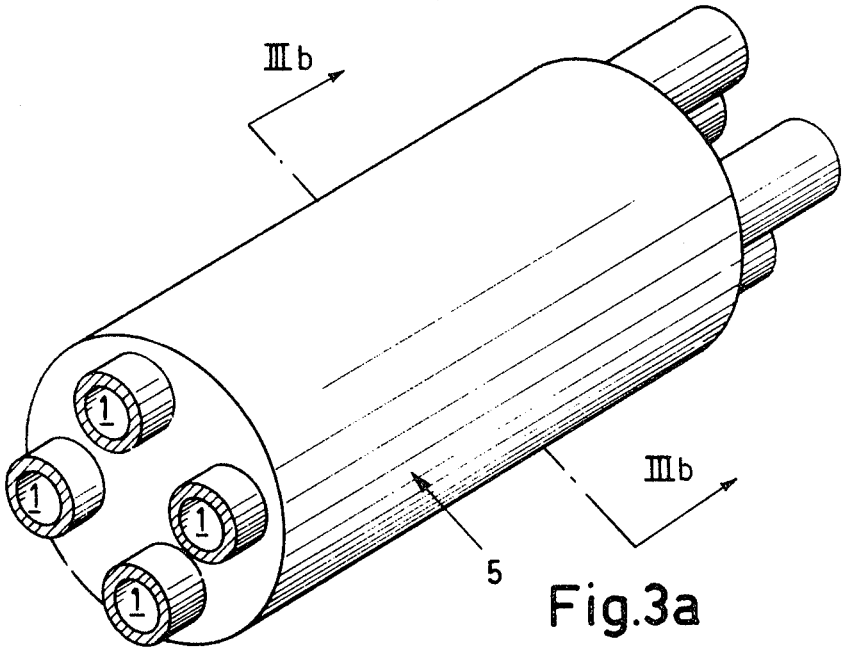
FIG. 3*a* is a perspective view of a third embodiment of an oven of this invention comprising heating chambers having a circular cross-section surrounded by a circularly constructed commmon reservoir.
Figure 3B:
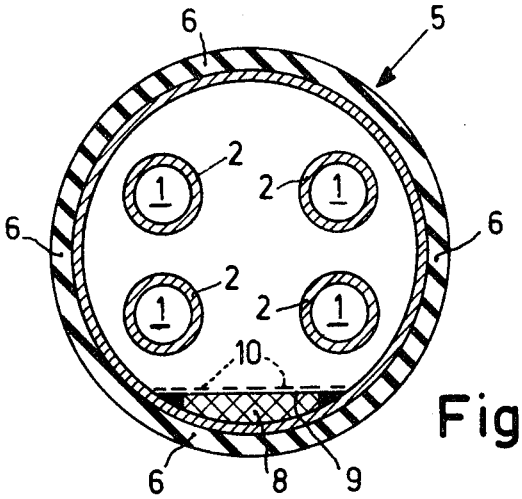
FIG. 3*b* is a sectional view of the oven taken along line III*b*—III*b* of FIG. 3*a*.
Figure 4A:
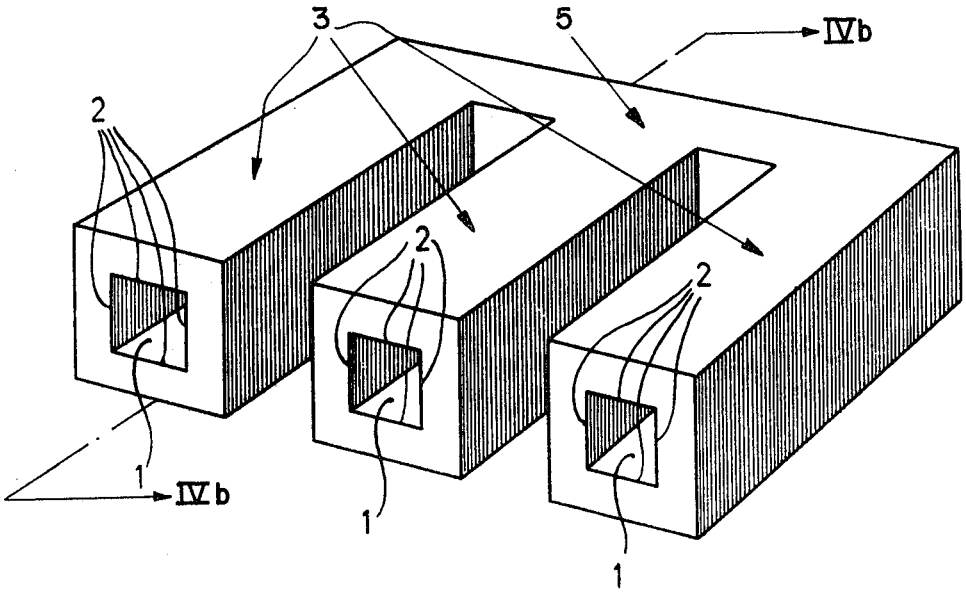
FIG. 4*a* is a perspective view of a fourth embodiment of an oven of this invention comprising three heating chambers.
Figure 4B:
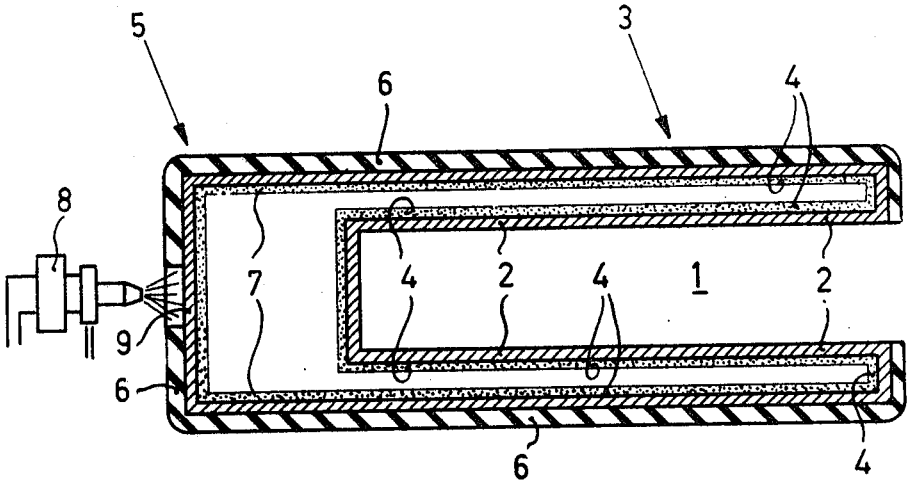
FIG. 4*b* is a sectional view taken along line IV*b*—IV*b* of FIG. 4*a*.

FIGS. 3*a* and 3*b* show an oven comprising heating chambers having a circular cross-section, surrounded by the cylindrically constructed common reservoir within which the common heat source is arranged. Only the common reservoir evaporation wall 9 is provided with a capillary structure 10 which now ensures that the said wall is uniformly moistened. Sodium condensate is returned from the heat-transmission walls 2 to the common reservoir evaporation wall 9 by gravity. The construction is very compact and simple. FIGS. 4*a* and 4*b* show an oven comprising three heating chambers 1 which are accessible on only one side and which are bounded by double-walled reservoirs of rectangular cross-section which open into the common reservoir. The rear of the double-walled reservoirs 3 opens into common reservoir 5. In the reservoirs 3 as well in the common reservoir 5 a capillary structure, 4 and 7, respectively, is present, the said structures being interconnected. Common heat source 8 again consists of a burner. Liquid sodium evaporates from common reservoir evaporation wall 9 and condenses directly on the heat-transmission walls 2 again. The return of condensate is effected via capillary structures 4 and 7 successively.

What is claimed is:

1. Heating apparatus for use with a heat source, which comprises an enclosed common heat reservoir, at least a portion of at least one wall of said common heat reservoir being associated with said heat source, a plurality of separate isothermal heating units traversing through said common heat reservoir and being formed of concentrically arranged spaced inner and outer tubular members, each end of each heating unit extending outwardly of said common heat reservoir, each said inner tubular member defining a heating chamber and each said pair of spaced tubular members together defining an annular heat reservoir in communication with said common heat reservoir, each end of each said annular heat reservoir being closed, a first capillary material on the inner surface of the walls of said common heat reservoir, a second capillary material on the inner surface of the walls of each said annular heat reservoir, and a third capillary material extending between said second capillary material and said first capillary material, and a vaporizable and condensible heat-transporting medium in said common heat reservoir and said annular heat reservoirs, said medium, when heat is supplied to the common heat reservoir by said heat source, vaporizing and flowing into the annular heat reservoirs wherein it condenses and provides heat for transmittal through the respective inner tubular members into the respective heating chambers, the resulting medium condensate flowing back into said common heat reservoir at least partly by means of said third capillary material.

2. Apparatus according to claim 1, in which each said pair of spaced tubular members is substantially rectangular in cross section.

3. Apparatus according to claim 1, in which the heat-transporting medium comprises sodium.

* * * * *

UNITED STATES PATENT OFFICE

CERTIFICATE OF CORRECTION

Patent No. 4,095,647 Dated June 20,1978

Inventor(s) George A.A. Asselman

It is certified that error appears in the above-identified patent and that said Letters Patent are hereby corrected as shown below:

Change Foreign Application Priority Data from

"July 9,1972" to -- July 19,1972 --

Signed and Sealed this

Third Day of February 1981

[SEAL]

Attest:

RENE D. TEGTMEYER

Attesting Officer

Acting Commissioner of Patents and Trademarks